US006750785B2

(12) United States Patent
Trajkovic et al.

(10) Patent No.: US 6,750,785 B2
(45) Date of Patent: Jun. 15, 2004

(54) COLLABORATIVE SPEED DETECTION WARNING DEVICE

(75) Inventors: Miroslav Trajkovic, Ossining, NY (US); Srinivas Gutta, Buchanan, NY (US); Antonio Colmenarez, Peekskill, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 166 days.

(21) Appl. No.: 09/928,612

(22) Filed: Aug. 13, 2001

(65) Prior Publication Data

US 2003/0030571 A1 Feb. 13, 2003

(51) Int. Cl.[7] ..... G08G 1/00

(52) U.S. Cl. ..... 340/901; 340/903; 340/905; 342/20

(58) Field of Search ..... 340/901, 902, 340/903, 905, 555, 556; 342/20, 70, 61; 455/575

(56) References Cited

U.S. PATENT DOCUMENTS

| | | | | |
|---|---|---|---|---|
| 5,977,884 | A | * 11/1999 | Ross | 340/936 |
| 6,201,493 | B1 | * 3/2001 | Silverman | 342/20 |
| 6,265,989 | B1 | * 7/2001 | Taylor | 340/901 |
| 6,366,216 | B1 | * 4/2002 | Olesen | 340/825.49 |
| 6,426,706 | B1 | * 7/2002 | King | 340/903 |
| 6,462,675 | B1 | * 10/2002 | Humphrey et al. | 340/905 |
| 6,469,653 | B1 | * 10/2002 | Haynes | 144/134.1 |

* cited by examiner

*Primary Examiner*—John Tweel
(74) *Attorney, Agent, or Firm*—Aaron Waxler

(57) ABSTRACT

A collaborative speed measurement device detection system provides early warning and increased reliability by sharing the responses of multiple detectors through a broadcast radio network. A vehicle with one detector (e.g., radar, laser detector) broadcasts a detection event to any other detectors in its vicinity. The receiving detectors generate a warning signal in response to the broadcast. The receivers can combine the results of multiple detections to generate a reliability estimate. The location of the detection events may be broadcast and used in generating alarms in the receiver as well.

8 Claims, 7 Drawing Sheets

COLLABORATIVE SPEED DETECTION WARNING DEVICE

BACKGROUND OF THE INVENTION

1. Field of the Invention

The invention relates to warning devices that give notice of the use of speed detectors, for example by law enforcement agencies, such as radar detectors. More particularly, the invention relates to such systems that employ multiple receivers to increase reliability and lead time of warnings.

2. Background

Many operators of motor vehicles utilize radar detectors to alert them to the fact that their speed is being monitored by law enforcement agencies. However, conventional radar detectors often generate "false alarms." They are also prone to respond too late, giving the vehicle operator insufficient time to adjust speed.

False alarms are annoying to the operators of motor vehicles. In fact, various automotive publications publish results of "false alarm" tests. Thus, anything that can be accomplished by the manufacturer to reduce the number of false alarms without reducing detection of police radar is commercially valuable In addition to police radar signals, there are many different sources of microwave signals in the frequency bands allocated to police radar by the U.S. Federal Communications Commission (FCC). For example, motion-detecting burglar alarms and automatic door openers also operate in the frequency bands allocated to police radar. Thus, a need exists for a radar detector that can distinguish between signals generated by a police radar transmitter and those generated by other devices that utilize microwave signals within the same frequency bands.

As is known in the art, speed detection systems may be used to determine the speed of moving objects, such as ground based or airborne motor vehicles for example. It is often desirable for the operator of the moving vehicle to know when the speed of the vehicle is being measured. For example, it may be desirable for an operator of a moving automobile to know when the speed of the automobile is being detected by a speed detection system.

As is also known, such speed detection systems may utilize either radar or laser devices in their operation. A speed detection system that utilizes radar may generally be referred to as a so-called radar gun. Radar guns typically include a microwave signal source that emits a signal having a frequency in either the X, K or Ka frequency regions of the electromagnetic spectrum. Furthermore, radar guns may emit signals in either a continuous or a pulsed mode.

A laser speed detection system or so-called laser gun, on the other hand, includes a laser, which is a device that converts input power into a very narrow, intense beam of coherent energy at a single optical frequency, generally, but not necessarily, within the visible to infrared frequency region of the electromagnetic spectrum. Like radar guns, laser guns may also operate either continuously or in a pulsed mode. Laser guns generally operate in a pulsed mode due to input power requirements, cooling problems, and other considerations of the laser. The pulse width of the output of a pulsed laser is typically on the order of nanoseconds or picoseconds.

As is also known, there exists two particular classes of detecting systems generally referred to as radar detectors and laser detectors. A radar detector is a device used to detect the presence of a radar gun. A laser detector, on the other hand, is a device used to detect the presence of a laser gun. Typically, devices which detect the presence of radar guns are unable to detect the presence of laser guns. Similarly, devices capable of detecting the presence of laser guns are unable to detect the presence of radar guns.

Radar detectors typically detect signals having frequencies in the X-band, K-band and Ka-band frequency ranges. Such radar detectors often include a fixed frequency oscillator which generates a signal in the X-band frequency range. The so-called third harmonic of some X-band signals, however, fall generally within the Ka-band frequency range. Thus, one problem with conventional radar detectors which detect signals in the Ka-band frequency range is that such radar detectors may provide an alarm in response to the third harmonic signal of the fixed frequency oscillator of a nearby radar detector rather than in response to a signal emitted from a radar gun. This is generally referred to as a "false alarm" or simply "falsing."

Laser detectors also have problems with sounding false alarm signals in response to light signals emitted from sources other than laser guns. Laser detectors may also pose an additional problem in that they may be expensive, and may require accurate or pre-determined alignment or positioning of the laser detector within the path of a laser beam in order to function properly. Such systems are thus impractical for use by personnel on moving airborne and ground-based vehicles.

It would, therefore, be desirable to provide a detection device which detects the presence of both laser and radar speed detection systems and which is able to distinguish between signals provided from speed detection systems and signals provided from other detection devices such as other radar detectors. The other problem with all types of detectors is the extremely short notification provided by them. A driver has little time to adjust his/her speed after the warning is given before a speed estimate is generated by the scanning device used by the law enforcer. Thus, there exists a need in the art to provide more advanced warning of the use of laser, radar, and other scanning devices.

SUMMARY OF THE INVENTION

The invention provides a mechanism whereby detectors of speed detection devices, such as laser and radar speed detectors, communicate with each other so that each detector can use information available from other detectors to provide early warning and reliable detection. Each detector may be equipped with a radio transmitter and receiver. Upon detection of probe signal, a data signal is generated and received by all detectors in the vicinity. Recipients of the signal may generate a warning or use the information to generate a reliability metric to determine whether a warning should be generated.

The invention will be described in connection with certain preferred embodiments, with reference to the following illustrative figures so that it may be more fully understood. With reference to the figures, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
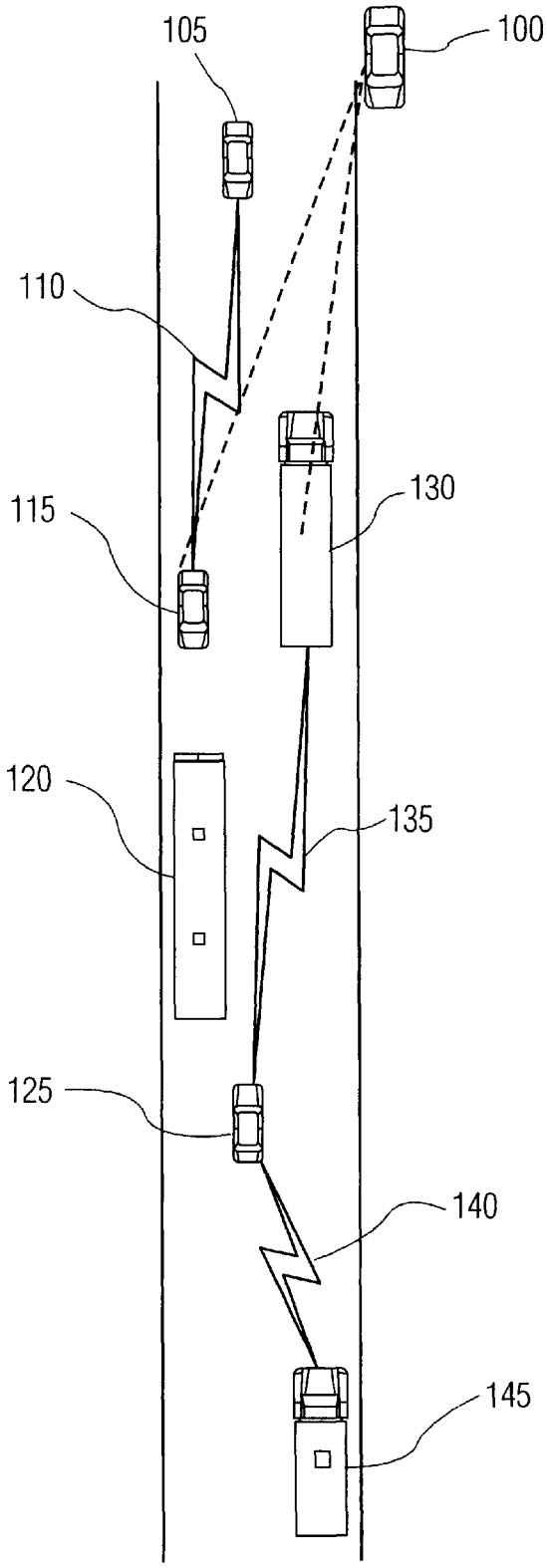
FIG. 1 is a figurative illustration of a number of vehicles with collaborative detectors according to an embodiment of the invention.

Referring to FIG. 1, a speed detector 100 illuminates several vehicles 115 and 130 with a radio or laser scan to determine their speed. The illuminated vehicles 115 and 130 are equipped with detectors, such as a radar or laser detector (not shown in the figure), with the added capability of transmitting broadcast signals to other vehicles such as 105 and 125 as illustrated by the communication links 110 and 135. Vehicle 125 further rebroadcasts the signal, as indicated by link 140, to another vehicle 145, which is further up the road. Not all vehicles on the road need have detectors with an ability to transmit and receive broadcast signals. Such vehicles 120 simply do not respond in any way.

Data transmitted by the illuminated vehicles may include the following information:

1. location given by global positioning system (GPS) subsystem of the vehicle when the illumination event was detected;
2. speed of the illuminated vehicle given by the GPS when the illumination event was detected;
3. heading of the illuminated vehicle given by the GPS when the illumination event was detected; and
4. reliability estimate based on the detector's ability to generate such.

Figure 2:
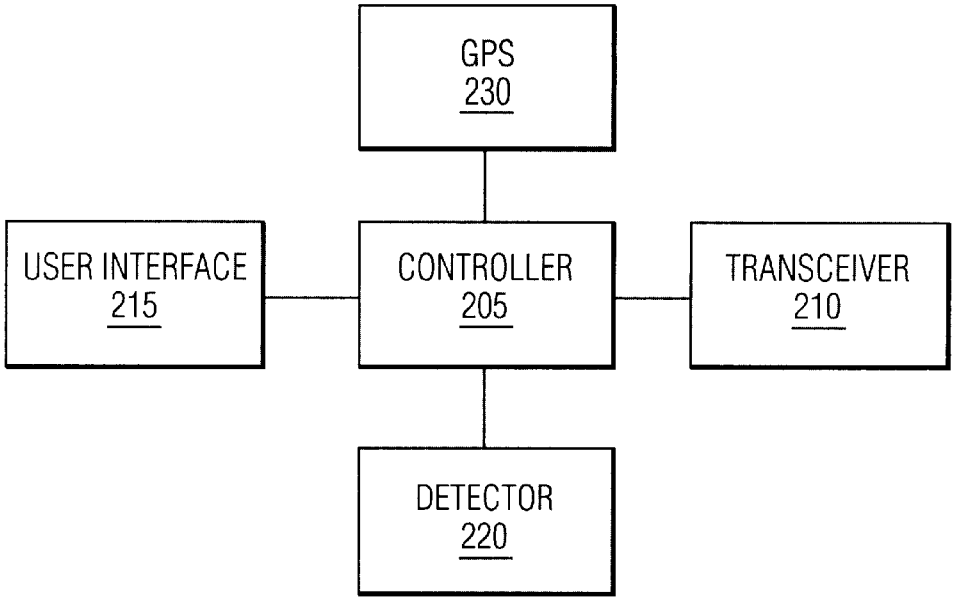
FIG. 2 is a block diagram of a node of a collaborative detector according to an embodiment of the invention.

Referring now to FIG. 2, a collaborative speed measurement detector system 200 includes a controller 205, which may exchange data with a GPS subsystem 230, a radio transceiver 210, a speed measurement detector 220, and a user interface 215.

Figure 3:
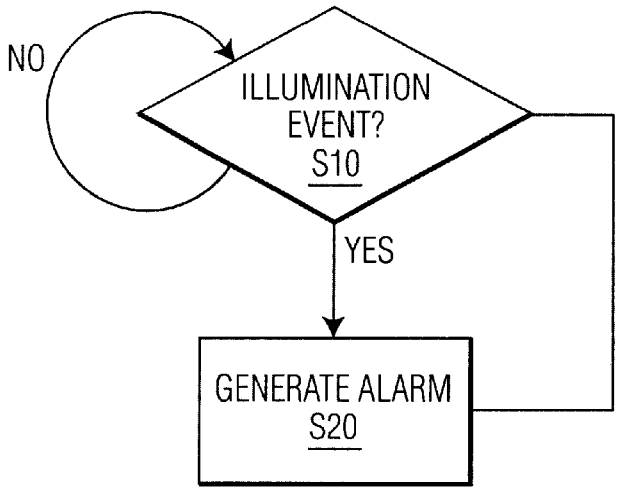
FIG. 3 is a flowchart illustrating a method for controlling a collaborative radar detector according to a first embodiment of the invention.

In a simple embodiment, the collaborative speed measurement detector system 200 may consist solely of the detector 220, controller 205, and a rudimentary user interface 215. Referring now also to FIG. 3, in such a simple embodiment, a signal indicating detection of an illumination event (the detection of radar or laser from a detector as indicated at 100 in FIG. 1) is generated by the transceiver 210 which is then picked up by the transceivers 210 of nearby collaborative speed measurement detector systems 200, but not forwarded in step S10, at which point an idle loop is exited and an alarm generated in step S20. Alternatively, the idle loop of step S10 may be exited by a local detection event with the same effect. In a simple embodiment, the signal may not be repeated and only broadcast by the collaborative speed measurement detector system 200 that actually detected the illumination. In this simple embodiment, the collaborative speed measurement detector system 200 generates the warning signal through the user interface 215 if it receives a broadcast signal from another collaborative speed measurement detector system 200 or if it detects an illumination event through the detector 220 or if it receives a signal from another collaborative speed measurement detector system 200.

Figure 4:
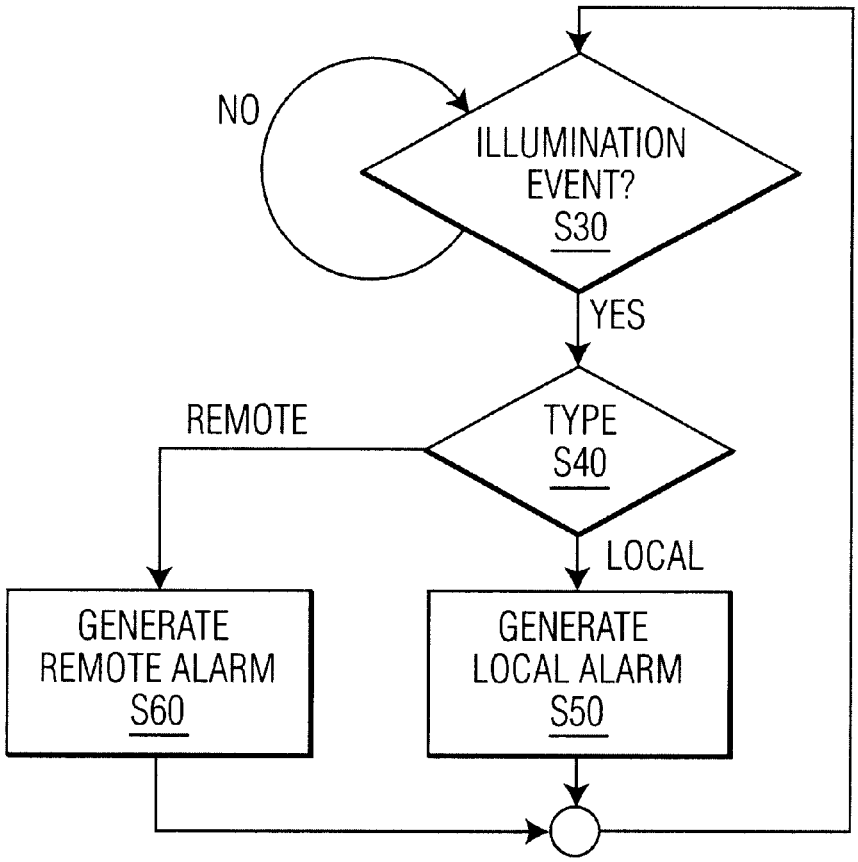
FIG. 4 is a flowchart illustrating a method for controlling a collaborative radar detector according to a second embodiment of the invention.

Referring now also to FIG. 4, in a refinement of the above system, the controller 205 is programmed to generate different signals in the user interface depending on the type of alarm condition; direct detection of illumination or detection by another collaborative speed measurement detector system 200. In step S30, an idle loop waits for either receipt of signal from another collaborative speed measurement detector system 200 or a local illumination event. When the loop S30 is exited, in step S40 the type of illumination event, remote (a signal was received from another collaborative speed measurement detector system 200) or local (an illumination event was detected by the collaborative speed measurement detector system 200 itself) is determined. Here, it is contemplated that a local illumination event would correspond to a more urgent condition than a remote one, for two reasons. One reason is that a remote illumination event has a higher probability of being irrelevant, potentially being from a different road or from traffic in an opposing direction. The other is that the distance to the detector is probably further away than when a local illumination event is detected and therefore warrants less immediate response. If the type of event is a local detection, a local alarm is generated in step S50, otherwise a remote alarm is generated in step S60. The remote and local alarms could simply be different audio signals, or colored lights (e.g., local=red and remote=yellow). Many alternative alarm signals are possible such as machine speech, graphical icons on a display, etc.

Figure 5:
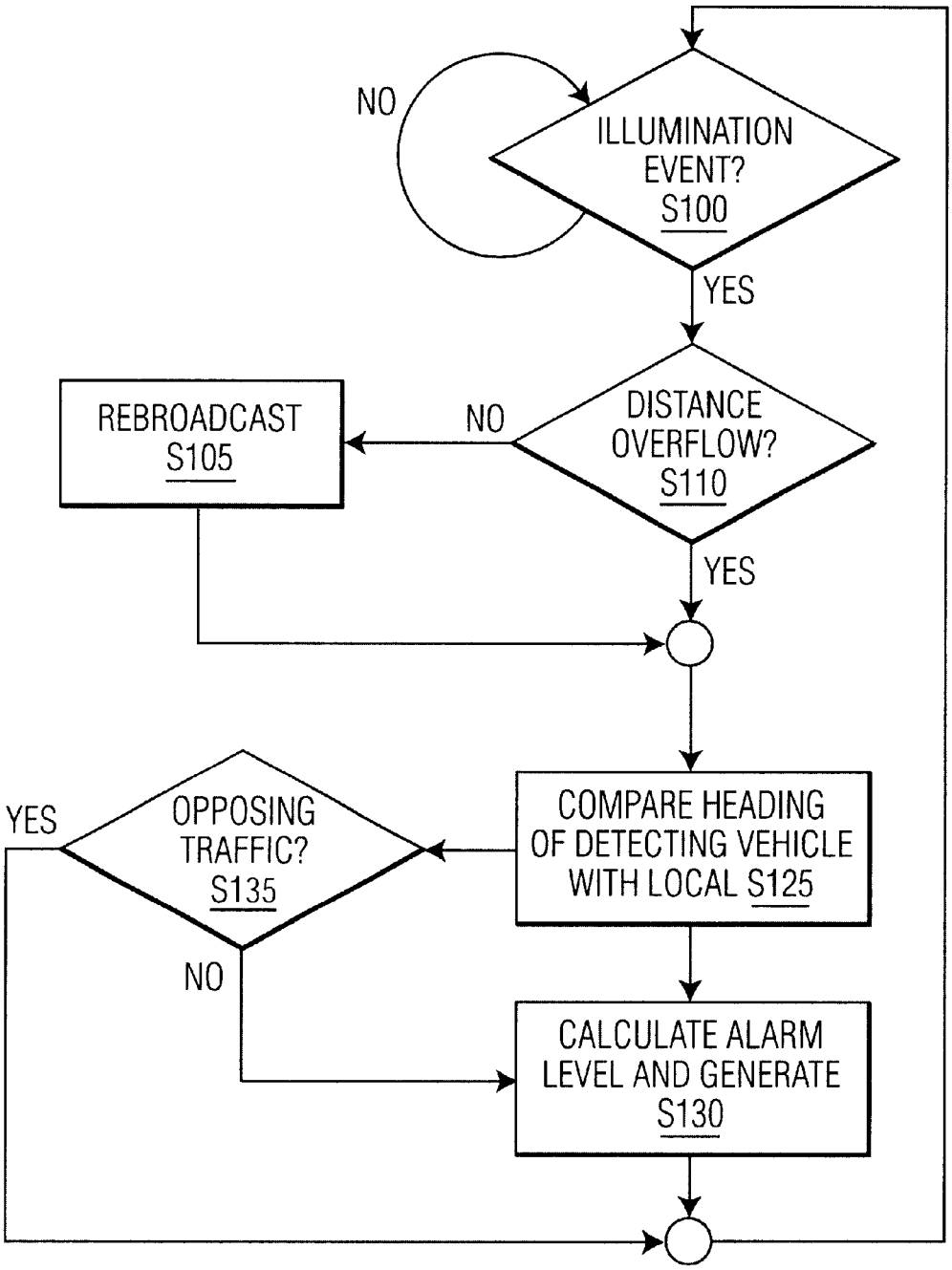
FIG. 5 is a flowchart illustrating a method for controlling a collaborative radar detector according to a third embodiment of the invention.

Referring now also to FIG. 5, in a further refinement of the previous embodiment, the heading and speed of the vehicle carrying the collaborative speed measurement detector system 200 that detected the illumination event are transmitted and used by other collaborative speed measurement detector systems 200. Also, collaborative speed measurement detector systems 200 rebroadcast the illumination event detection signal to extend the range of the devices, particularly in the vicinity of obstacles such as bridges, or buildings.

As in the previous embodiment, in step S100, an idle loop waits for either receipt of signal from another collaborative speed measurement detector system 200 or a local illumination event. In step S110, the distance to the transmitting collaborative speed measurement detector system 200 is compared to an upper limit. If the distance is over the limit, the signal is not rebroadcast. If it is under the limit, the signal is rebroadcast in step S105. In step S125, the heading of the vehicle whose collaborative speed measurement detector system 200 received the illumination event signal is compared with the headings, potentially combined with distance information, indicate that the transmitter is headed in a direction opposite that of the receiver, determined in step S135, then no alarm level is calculated or generated in step S130. Otherwise, an alarm is generated in step S130.

Before generating an alarm, an alarm level may be generated, the level corresponding to a reliability/urgency estimate for the alarm condition. In the embodiment of FIG. 5, the heading and distance from the illumination event may be used to estimate the degree of reliability and urgency of the event. For example, if there is a high probability, but less than 100% certainty, that a vehicle in opposing traffic generated the illumination event signal, then the alarm level could be set to a low value. If the illumination event occurred a great distance away, then the alarm level could also be set to a low value. If the illumination event were local, the alarm level would be set to a high value. Different outputs could correspond to the different alarm levels.

Figure 6:
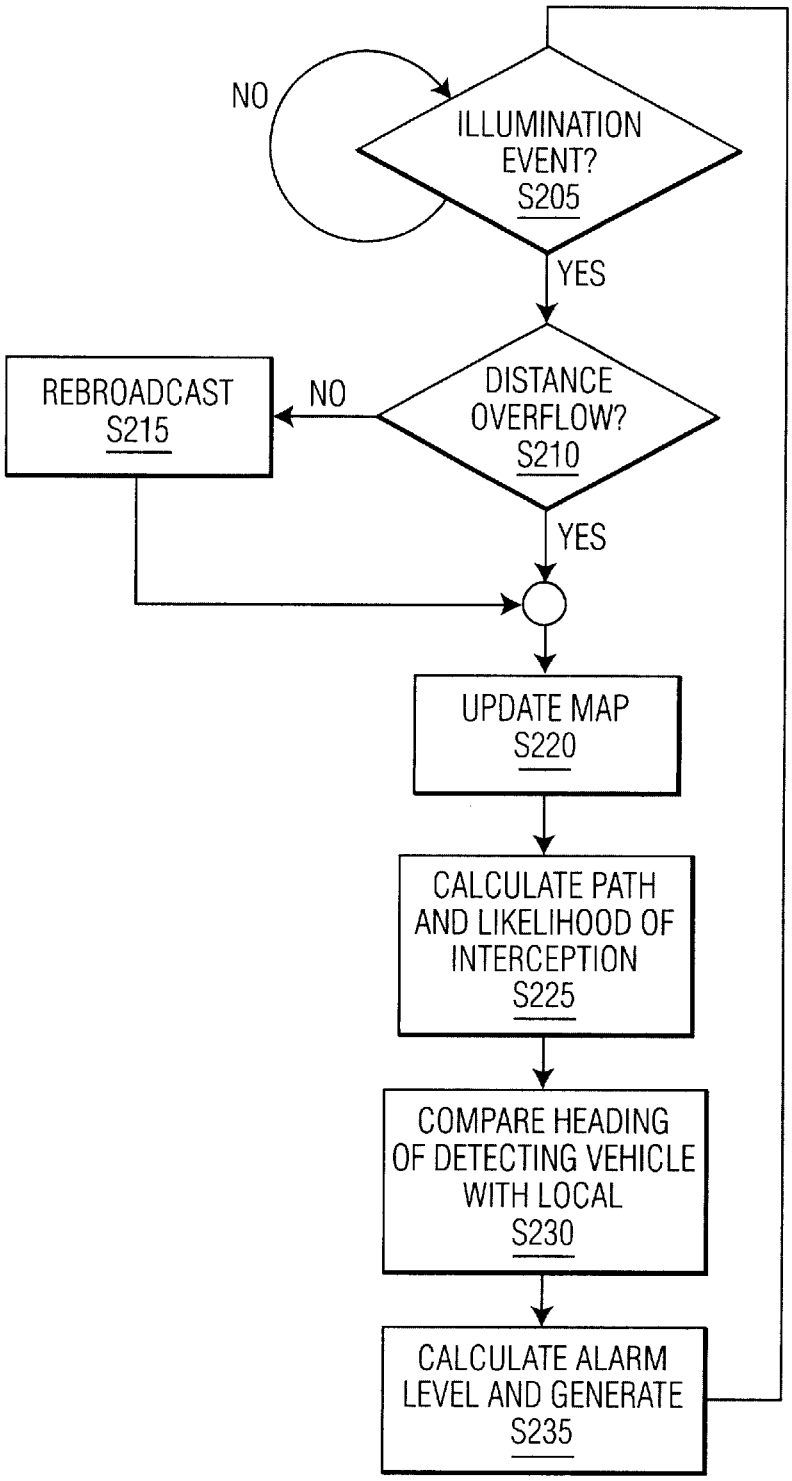
FIG. 6 is a flowchart illustrating a method for controlling a collaborative radar detector according to a fourth embodiment of the invention.

Referring now also to FIG. 6, a map of illumination events is updated each time an illumination event signal is received (local or remote). As in the previous embodiment a loop S205 is exited when an illumination event occurs and the signal is rebroadcast (S215) if (S210) the location of the illumination event is closer than some predefined limit. In step S220, the data corresponding to the illumination event is used in updating a map of illumination events in the vicinity of the collaborative speed measurement detector system 200. The map may be a database with records specifying each event. The records may each contain a field indicating the time of the event, its location, a vehicle heading upon detection of the event, and a reliability estimate based on other criteria employed by prior art laser and radar detectors. In step S225, the database is filtered and a probability of intercepting the area of illumination is calculated for each entry in the database. In step S230, the heading of the local vehicle is compared with those of the illuminated vehicles in the map database and the probability of intercepting the illumination area adjusted accordingly. In this case, instead of determining if the vehicle transmitting the illumination event signal is different from that of the receiving vehicle, the vehicle headings are used to adjust a probability that the local vehicle will intercept the illuminated area, the probability being adjusted downwardly the more the vehicle headings appear to be opposite in general direction and upwardly, the more the headings appear to be generally the same. In step S235, the worst-case alarm level is calculated and the corresponding alarm level generated.

Note that the heading information may be time-integrated heading. Alternatively, the heading information may be one of the two possible directions of the route determined by the GPS system 230 to be the one on which the vehicle is travelling. The illumination event signal may contain a route indicator as well as a direction indicator. This may be compared with a route and direction predicted for the receiving vehicle. The prediction may be based on current location and direction as in map-matching software used for GPS navigation systems or it may be based on a route plan indicated by the user in a vehicle navigation system.

Figure 7A:
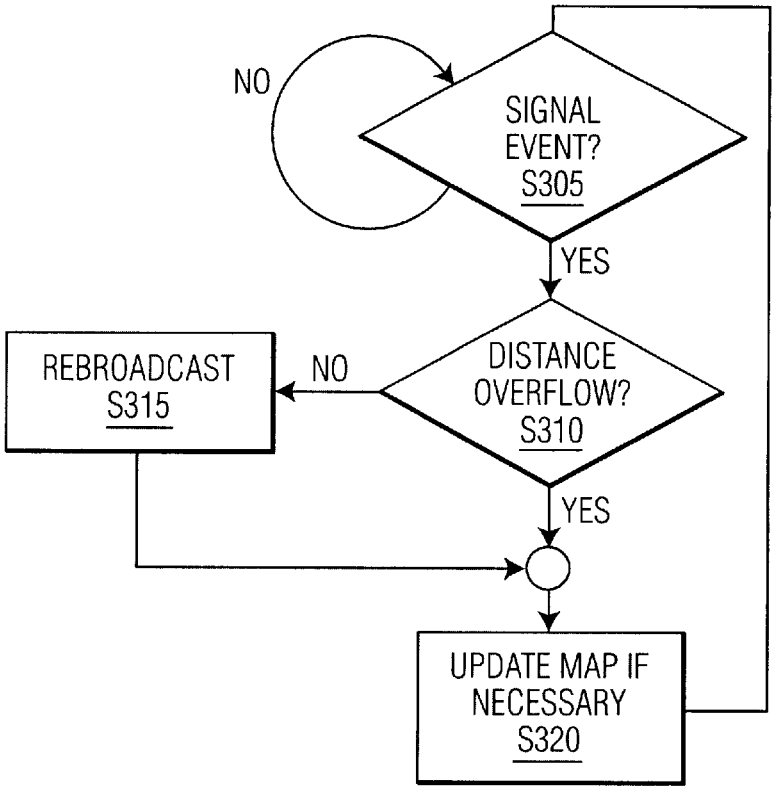
FIGS. 7A–7C are flowcharts illustrating a method for controlling a collaborative radar detector according to a fifth embodiment of the invention.
Figure 7B:
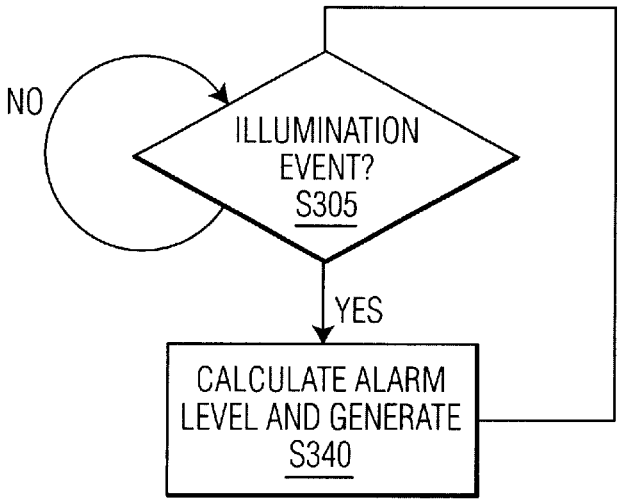
Figure 7C:
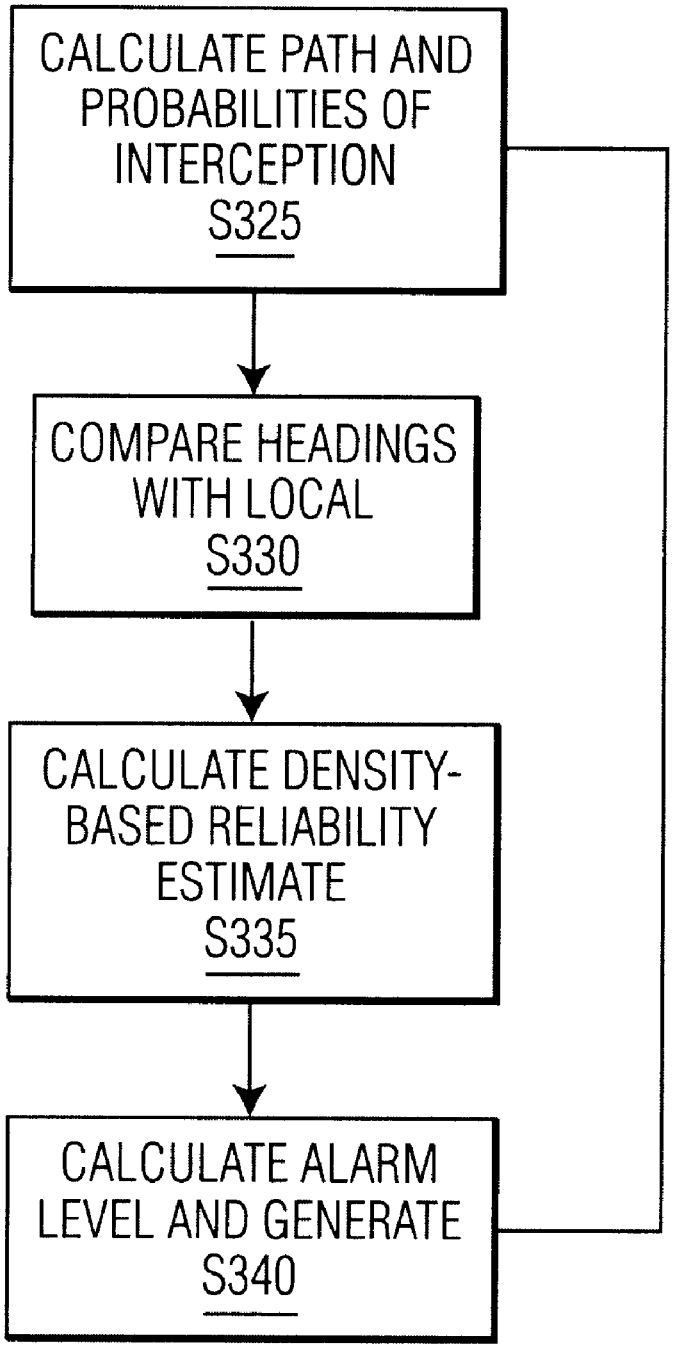

Referring now to FIG. 7A, a first process continually updates the map described with respect to the embodiment of FIG. 6. The loop through step S305 is exited upon reception of a signal indicating an illumination event. In the present embodiment, it is assumed the signal can be either an illumination event signal or an idle signal simply indicating other vehicles that are "connected" to the local collaborative speed measurement detector system 200. The reason for the idle signal will become clear from the discussion of FIG. 7C. If (S310) the distance to the event is not too great, the signal is rebroadcast in step S315. The map is updated with the data in the illumination event signal as discussed above with respect to the embodiment of FIG. 6. Referring now also to FIG. 7B, simultaneously, an idle loop through a test S305 is exited upon detection of a local illumination event. When a local illumination event is detected, an alarm is immediately generated in step S340. Referring now also to FIG. 7C, another simultaneous process continuously updates the alarm level of the map database entries as the vehicle carrying the collaborative speed measurement detector system 200 (the local vehicle) moves.

In the process of FIG. 7C, a path projection of the local vehicle and probabilities of each illumination location in the map database being intercepted along the path projection are calculated in step S325 and the map database updated. The headings of the sending collaborative speed measurement: detector systems 200 are compared with the local heading in step S330. Again, alternatively, the illumination event signal may indicate the route and travel direction and the local GPS may provide corresponding information permitting the system to determine with greater certainty whether the sender and receiver are on the same route.

In step S335, a reliability adjustment calculation may be made for each illumination event based on the number of illumination events for a given location normalized by the density of traffic. The latter may be indicated by the idle signals from other collaborative speed measurement detector systems 200. Thus, where the number of other collaborative speed measurement detector systems 200 in a vehicle's vicinity is high, but the number of illumination event signals received is low, the illumination event can be discounted as a false-positive. In step S340 an alarm level is calculated for each entry in the map database and an alarm signal generated as appropriate (which may include not alarm signal being generated).

It will be evident to those skilled in the art that the invention is not limited to the details of the foregoing illustrative embodiments, and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A speed detector detection system, comprising:

a first speed detector sensor in a first vehicle adapted to detect energy emitted by at least one type of speed detector;

a first radio transmitter connected to receive a signal from said first speed detector sensor indicating a detection of energy of a speed detector and generate a radio signal indicating said detection;

a second radio receiver in a second vehicle adapted to receive said signal and generate an alarm signal responsively thereto.

2. A system as in claim 1, wherein said second vehicle contains:

a second speed detector sensor adapted to detect said energy emitted by said at least one type of speed detector;

a second radio transmitter connected to receive a signal from said second speed detector sensor indicating a detection of energy of a speed detector and generate a further radio signal indicating said detection.

3. A method of warning a user of the presence of a speed detector, comprising the steps of:

detecting at a first vehicle a speed detector;

transmitting a first warning signal at said first vehicle;

receiving said first warning signal at said second vehicle;

generating an alarm signal at said second vehicle responsively to said step of receiving.

4. A method as in claim 3, further comprising the step of:

transmitting at least a third warning signal from a third vehicle; and receiving said at least a third warning signal at said second vehicle;

said step of generating including deriving a reliability figure responsively to said at least a third warning signal and said first warning signal.

5. A method of warning a user as to the presence of a speed detector, comprising the steps of:

receiving a warning signal indicating a remote detection of speed-measurement devices;

detecting a speed-detection device;

generating at least one alarm signal responsively to said steps of receiving and detecting.

6. A method as in claim 5, wherein said step of receiving includes receiving a radio signal.

7. A method as in claim 5, wherein said step of detecting includes detecting one of radar energy and a laser energy.

8. A method as in claim 5, wherein said step of generating includes a first alarm responsive to said step of detecting and a second alarm signal responsive to said step of receiving.

* * * * *